United States Patent [19]

Kohl et al.

[11] 4,243,907

[45] Jan. 6, 1981

[54] LAMP HAVING REDUCED WIDTH PRESS-SEAL

[75] Inventors: Clyde B. Kohl, Winchester; George B. Kendrick; Raymond T. Fleming, both of Lexington, all of Ky.

[73] Assignee: GTE Products Corporation, Stamford, Conn.

[21] Appl. No.: 54,769

[22] Filed: Jul. 5, 1979

[51] Int. Cl.[3] ..... H01J 5/48; H01J 5/50

[52] U.S. Cl. ..... 313/318; 313/315; 339/144 R

[58] Field of Search ..... 313/315, 318; 339/144 R

[56] References Cited

U.S. PATENT DOCUMENTS

| | | | |
|---|---|---|---|
| 3,001,097 | 9/1961 | Smialek | 313/318 |
| 3,500,105 | 3/1970 | Westlund, Jr. et al. | 313/315 X |
| 3,555,338 | 1/1971 | Scoledge | 313/315 |
| 3,622,832 | 11/1971 | Schlessel | 313/315 |
| 4,139,794 | 2/1979 | Malm et al. | 313/318 |
| 4,152,622 | 5/1979 | Fitzgerald | 313/318 |

*Primary Examiner*—Saxfield Chatmon, Jr.
*Attorney, Agent, or Firm*—Edward J. Coleman

[57] ABSTRACT

A tungsten-halogen lamp having a tubular envelope of quartz or high silica glass has a press-seal at one end which is reduced in width by the removal of right-angled sections from opposite lower corners of the press. The lamp further includes a ceramic base having a slot with closed ends for accommodating the reduced width portion of the press-seal.

6 Claims, 4 Drawing Figures

LAMP HAVING REDUCED WIDTH PRESS-SEAL

BACKGROUND OF THE INVENTION

This invention relates to lamps having lead-in wires which are hermetically sealed through an end of the lamp envelope by pinching the envelope material to form a press-seal and, more particularly, to tungsten-halogen lamps having a tubular envelope of quartz or high silica glass with a press-seal at one end.

Such lamps are often employed in high wattage applications and include one or more tungsten filaments enclosed within a sealed envelope of quartz or high silica glass. The atmosphere within the envelope generally contains a halogen, such as iodine or bromine, whereby the lamp operates on a regenerative cycle initiated when a tungsten halide is produced and chemically combines with the particles evaporated from the incandescing tungsten filament. Subsequent thermal decomposition of this compound replaces the tunsten particles in the filament.

In the fabrication of these lamps, the important sealing operation includes using wafer-thin strips of molybdenum foil as current conductors in the seal area. These strips respectively are welded between outer lead-in wires and inner lead-in wires functioning as a filament support wires and assembled into a quartz of high silica glass tubular envelope; thereafter, an end portion of the envelope is softened, and a mechanical sealing die is utilized to form the seal. This sealing operation pinches the area where the molybdenum strip bridges the lead-in wires and provides a vacuum-tight seal, referred to as a press-seal. The width of this press-seal is at least as wide as the diameter of the tubular envelope and generally somewhat wider. Depending upon the die used in pinching this sealed area, the lower corners of the press-seal may define a semi-rectangular configuration, or the sides of the press-seal may be pinched out into a somewhat irregular contour.

Normally, in the basing of such lamps, especially the high wattage types, a ceramic base holder is utilized with prongs, buttons, or the like, for connection to the lead-in wires. Typically, the ceramic base is provided with a slot for receiving the press-sealed, single-ended lamp. The lamp is fitted and aligned into the slot in the ceramic base and secured therein by applying a basing cement completely around the press-seal of the lamp envelope.

In order to satisfy some lamp applications, it is necessary to provide a comparatively large glass envelope. The resulting end seal section of the envelope reserved for a base member may then be too large to fit existing basing means and holding devices. For example, whereas the application in which a given lamp is to be used may only accommodate a base designed for a T4 press-seal, the light output requirements may require the use of a larger T6 bulb. The press-seal of the T6 tubular envelope, however, would clearly not fit the smaller T4-adaptable base. One approach which has been employed to overcome this problem has been to use the comparatively non-standard G6 globular bulb which is manufactured by using a blown T4 tabulation at considerably higher cost as compared to conventional manufacturing processes. The non-uniform configuration of the globular bulb also requires special care to maintain bulb to exhaust tube alignment.

SUMMARY OF THE INVENTION

In view of the foregoing, it is an object of this invention to provide an improved lamp construction for matching enlarged envelope requirements with the constraints of a smaller base size.

A particular object of the invention is to provide a tungsten-halogen lamp having a tubular envelope with a press-seal at one end economically adapted to fit a base smaller than that conventionally matched with the diameter of that envelope.

A further object is to provide a more economically and readily manufacturable lamp conforming to the aforementioned objects.

These and other objects, advantages and features are attained, in accordance with the principles of this invention, by providing a lamp with a sealed envelope of vitreous material having a press-seal at one end, wherein at least a portion of the press-seal has a reduced width as provided by removing right-angled sections from opposite lower corners thereof. According to a preferred embodiment, the lamp is of a tungsten-halogen type having a substantially tubular envelope comprised of quartz or high silica glass. Enclosed within the sealed envelope is a halogen-containing atmosphere and a tungsten filament connected across a pair of lead-in wires which are hermetically sealed by way of respective metal foil strips through the press-seal in spaced-apart relationship to one another and extending beyond the press-seal. The lamp further includes a base member of insulating material, such as ceramic, having a slot with closed ends therein for accommodating the reduced width portion of the press-seal. The envelope is positioned on the base with the reduced width portion of the press-seal disposed in the slot for rigidly holding the position of the envelope within the base.

The reduced width of the press-seal can be provided either by using horizontal and vertical right-angled saw cuts to remove sections from opposite lower corners of the press-seal, or horizontal notches may be formed on opposite sides of the press-seal such that upon using respective vertical saw cuts up to the notches, the outer sections of the press-seal may thereafter be broken off and removed. In this manner, a standard T6 bulb size can be economically and readily adapted to a smaller base size by modifying the T6 press-seal width to fit a base designed for a T4 press-seal width. Hence, the aforementioned G6 bulb, which is non-standard, could be replaced by a standard T6 bulb, thereby attaining a significant cost reduction in accommodating the requirement for a relatively large envelope size matched to a comparatively small base size.

BRIEF DESCRIPTION OF THE DRAWINGS

This invention will be more fully described hereinafter in conjunction with the accompanying drawings, in which.

DESCRIPTION OF PREFERRED EMBODIMENTS

Figure 1:
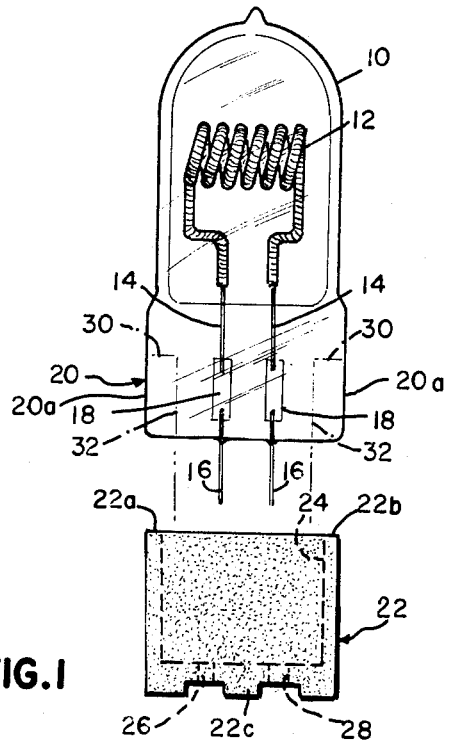
FIG. 1 is an elevational view of a lamp and base in a pre-assembled position, with horizontal and vertical dashed lines denoting the right-angled sections to be removed from the press-seal, in accordance with the invention.

Referring to the drawings, the lamp arrangement of our invention comprises an hermetically sealed vitreous envelope 10, for example, formed of quartz or high silica glass, which contains a coiled-coil tungsten filament 12 connected at its ends to respective lead-in conductor wires comprising inner and outer portions 14 and 16, respectively. The inner and outer lead-in wires are separated in the seal area by molybdenum foil strips 18 which are hermetically sealed in spaced-apart relation in a compressed protruding seal portion 20 formed at one end of the envelope. The outer portions 16 of the lead-in conductor wires extend beyond this press-seal area 20.

The particular lamp shown is of the well-known halogen-cycle type where during lamp operation a small amount of, for example, iodine vapor functions as a getter to combine with tungsten that is vaporized from the filament 12 onto the envelope wall to thereby form a tungsten iodide which migrates back to the vicinity of the filament where it then redeposits tungsten onto the filament and releases iodine for continuation of the cycle.

As viewed in FIG. 1, one embodiment of the lamp according to the invention is illustrated in a pre-assembled relationship. The main elements are the envelope 10 and a preformed base 22, comprised of an insulating material, such as ceramic. Referring also to FIG. 3, base 22 is formed to provide a slot 24 having closed ends 22*a* and 22*b*. The bottom wall 22*c* of the base is provided with openings 26 and 28 for accommodating terminals to which the lead-in wires are connected when the lamp assembly is complete. As is apparent from FIG. 1, the maximum ordinary width of the press-seal 20 area is larger than the longitudinal dimension of the slot 24 in the desired matching base; in fact, the press-seal may even be somewhat wider than the entire base 22, as is apparent in FIG. 2.

In accordance with the present invention, this press-seal area of the comparatively large lamp envelope 10 is accommodated to fit into the smaller base member 22 by reducing the width of at least a portion of the press-seal 20 in a substantially symmetrical manner as illustrated by the dashed lines 30 and 32. More specifically, right-angled sections 20*a* are removed from opposite lower corners of the press-seal by using horizontal and vertical right-angled saw cuts 30 and 32, respectively (as denoted by the dashed lines). That is, the press sections 10*a* are removed by placing two cutting blades at the desired spacing and then sawing (grinding) up both sides at a width less than the longitudinal dimension of slot 24 in base 22 and a specific distance to allow complete insertion of the press seal into this base slot. As previously mentioned, the dashed lines 32 denote the path defined by the vertical saw cuts. The horizontal saw cuts 30 are then made from each side of the press-seal 20 to coincide with the top of the vertical cut. In this manner, excess press-seal material 20*a* is removed from each side of the lead-in wires 14, 16 and molybdenum foil strips 18 to permit insertion of the reduced width portion of the press-seal into the base slot 24 without compromising the seal of the envelope 10.

In one example, the envelope bulb size is T6, and the matching ceramic base 22 is designed for a T4 press-seal. A T6 is defined as a tubular bulb having an outside diameter of six times $\frac{1}{8}$ inch, i.e. $\frac{3}{4}$ inch, and T4 is defined as a tubular bulb having an outside diameter of four times $\frac{1}{8}$ inch, which is $\frac{1}{2}$ inch.

Figure 2:
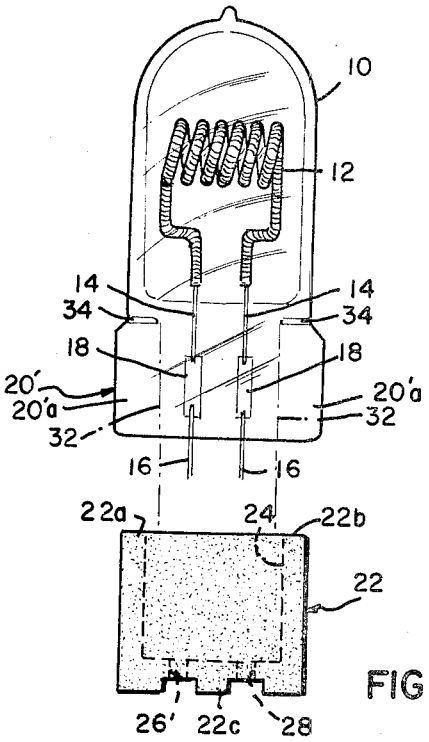
FIG. 2 is an elevational view of a lamp and a base in a pre-assembled position, with the press-seal of the lamp having horizontal notches on each side, which together with the illustrated vertical dashed lines denote the sections of the press-seal to be removed in accordance with an alternative embodiment of the invention.
Figure 3:
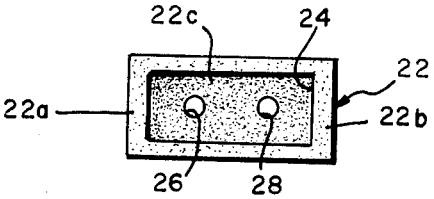
FIG. 3 is a top view of a base member showing the slot with closed ends located therein.

FIG. 2 illustrates an alternative embodiment of modifying a lamp press-seal in accordance with the invention. All portion of FIG. 2 having the same identifying numerals are identical to the corresponding portions described and illustrated with respect to FIG. 1. In this instance, however, the die employed in pinching the press-seal 20' at the end of the tubular envelope 10 is adapted to provide horizontal notches 34 on the front and back of both sides of the press 20'. Further, a controlled width of press 20' is maintained from the tubular portion of the bulb down to the notches 34 and then the press 20' is allowed to increase in width from the notch down to the end of the press. The reduced width portion of the press-seal for fitting into base 22 is provided by making spaced vertical saw cuts 32 up to the notches 34 on the press. The excess press sections 20°*a* are then readily broken off in a single operation.

The notched press-seal provides a means of break off and reduces the number of leaker capsules resulting from "cold pipes" along the edge of the press. The controlled width above the notches gives improved appearance and fit of the capsule to the base assembly and improved seal characteristics, while the uncontrolled press width below the notches reduces the refinement of temperature and pressure needed to provide a good seal with the advantage of easier setup and reduced shrinkage. Again, this approach has been employed to accommodate a T6 bulb size for fit into a ceramic base designed for a T4 press-seal. In another example, the press-seal width T8 bulb is reduced to fit a base adapted for accepting a T6 press-seal width.

Figure 4:
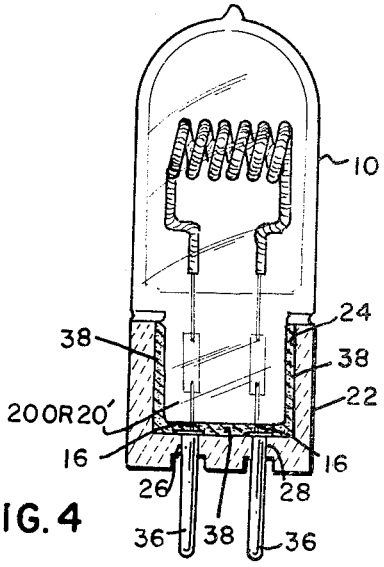
FIG. 4 is an elevational view of the completed lamp assembly, with the base portion shown in section.

FIG. 4 shows the complete lamp assembly. The lamp envelope 10 with a press-seal 20 or 20' reduced as described with respect to FIG. 1 or 2, respectively, is positioned on the base 22 with the reduced width portion of the press-seal 20 or 20' disposed within the base slot 24. When the lamp envelope is slid into the base slot 24, the lead-in wires 16 are fed through the base openings 26 and 28 and attached to suitable terminals, such as the pins 36 illustrated in FIG. 4. The lead-in wires 16 can be welded or soldered to the metal contact pins 36. The position of the envelope is then aligned within socket 22, and the slot 24 is filled with a suitable basing cement 38 which, when cured, rigidly holds the position of the lamp envelope in the base.

Although the invention has been described with respect to specific embodiments, it will be appreciated that modifications and changes may be made by those skilled in the art without departing from the true spirit and scope of the invention.

For example, vertical notches could be used in cooperation with horizontal saw cuts, or both vertical and horizontal notches could be used together, such that the corner sections could be broken off without the use of saw cuts.

We claim:

1. A lamp comprising:

a sealed envelope of vitreous material having a press-seal at one end;

a pair of lead-in wires hermetically sealed through said press-seal in spaced-apart relationship to one another and extending beyond said press-seal;

a filament connected across the inner ends of said lead-in wires; and at least a portion of said press-seal of vitreous material having a reduced width as provided by removing right-angled sections from opposite lower corners thereof, whereby said lamp press-seal is adapted to fit a base smaller than that conventionally matched with said envelope.

2. The lamp of claim 1 further including an insulating base member having a slot with closed ends therein for accommodating the reduced width portion of said press-seal, said envelope being positioned on said base with said reduced width portion of the press-seal disposed within said slot, and means for rigidly holding the position of said envelope in said base.

3. The lamp of claim 1 wherein said envelope is substantially tubular and the material thereof is selected from the group consisting of quartz and high silica glass, said filament is tungsten, the atmosphere with said envelope contains a halogen, and said lead-in wires are hermetically sealed by way of respective metal foil strips through said press-seal.

4. The lamp of claim 3 wherein the reduced width portion of said press-seal is provided by using horizontal and vertical right-angled saw cuts to remove sections from opposite lower corners of the press-seal.

5. The lamp of claim 3 wherein the reduced width portion of said press-seal is provided by forming horizontal notches on opposite sides of said press-seal, thereafter using respective vertical saw cuts up to said notches, and then breaking off and removing the outer sections of said press-seal defined by said notches and saw cuts.

6. The lamp of claim 3 further including a ceramic base member having a slot with closed ends therein for accommodating the reduced width portion of said press-seal, said envelope being positioned on said base with said reduced width portion of the press-seal disposed within said slot, and basing cement disposed in said slot for rigidly holding the position of said envelope in said base.

* * * * *